United States Patent [19]

Yamasaki et al.

[11] 4,205,641

[45] Jun. 3, 1980

[54] START CONTROL MEANS FOR INTERNAL COMBUSTION ENGINE

[75] Inventors: Tsunenori Yamasaki; Akira Ikeda; Takehiro Takashima, all of Hamamatsu, Japan

[73] Assignee: Yamaha Hatsudoki Kabushiki Kaisha, Shizuoka, Japan

[21] Appl. No.: 2,751

[22] Filed: Jan. 11, 1979

[30] Foreign Application Priority Data

Jan. 13, 1978 [JP] Japan ..... 53-2593

[51] Int. Cl.[2] ..... F02N 9/00; F02M 7/00; F02M 1/10

[52] U.S. Cl. ..... 123/179 G; 123/119 F; 261/39 B

[58] Field of Search ..... 123/179 G, 179 L, 180 T, 123/119 F; 261/39 B, 39 E

[56] References Cited

U.S. PATENT DOCUMENTS

| | | | |
|---|---|---|---|
| 2,230,184 | 1/1941 | Horton | 123/179 G |
| 3,587,553 | 6/1971 | Sutton | 123/179 G |
| 3,897,765 | 8/1975 | Harrison et al. | 123/179 G |
| 3,957,026 | 5/1976 | Winkley et al. | 123/179 G |
| 4,114,584 | 9/1978 | Rogerson et al. | 123/179 G |
| 4,132,221 | 1/1979 | Wilfert et al. | 123/179 L |
| 4,144,861 | 3/1979 | Yamashita et al. | 123/179 G |

*Primary Examiner*—Charles J. Myhre
*Assistant Examiner*—P. S. Lall
*Attorney, Agent, or Firm*—Kerkam, Stowell, Kondracki & Clarke

[57] ABSTRACT

An internal combustion engine having a starter carburetor in addition to a main carburetor. The starter carburetor includes a starting mixture passage provided with a starter valve which is normally open and adapted to be closed under an influence of the engine intake pressure when the engine temperature has reached a certain value. The engine includes a temperature responsive valve to mantain the influence of the engine intake pressure to hold the starter valve in the closed position after engine stop as far as the engine temperature is above a second certain value.

5 Claims, 6 Drawing Figures

START CONTROL MEANS FOR INTERNAL COMBUSTION ENGINE

The present invention relates to internal combustion engines and more particularly to start control means for internal combustion engines. More specifically, the present invention pertains to internal combustion engines having starting fuel supplying carburetors in addition to main carburetors.

In motorcycle engines, it has been a common practice to provide a starter carburetor for supplying an air-fuel mixture for engine start in addition to a main carburetor for supplying a mixture for normal engine operation. Such starter carburetor includes a starting mixture passage provided with a starting fuel nozzle and having a cross-sectional area which is small in relation to that of the intake passage provided in the main carburetor so that the mixture is passed through the starter carburetor at a relatively high speed. Thus, fuel can be atomized satisfactorily even in a starting period wherein the amount of intake air is relatively small. The starting mixture passage is further provided with a starter valve for opening the passage only in starting and warming-up periods.

In this type of starter carburetor, the starter valve is actuated by an engine operating pressure such as the engine intake pressure or the crank chamber pressure. In conventional starter carburetors, the starter valve is of a normally open type and adapted to be closed under the influence of the engine operating pressure when the engine has been started and the engine temperature has been increased beyond a predetermined value. Such normally open type starter valve is considered as being advantageous in that the supply of the starting mixture can be initiated without delay as soon as the engine is cranked. In order to provide a starter valve closing pressure, the line for drawing the engine operating pressure is provided with a check valve mechanism so that only the peak value of the pulsating engine operating pressure is applied to the starter valve. In this instance, the check valve mechanism is formed with a bypass passage whereby the valve closing pressure is released after the engine has been stopped.

In the aforementioned type of starter carburetor, however, inconveniencies have been experienced in that, even when the engine temperature is high, a starting mixture is supplied through the starting carburetor when the engine is cranked. Thus, there will be provided a mixture having an excessively rich overall air-fuel ratio. The starter carburetor of this type is therefore disadvantageous in respect of fuel economy and has a problem of ignition plug fouling.

It is therefore an object of the present invention to provide engine start control means in which the aforementioned problems are eliminated.

Another object of the present invention is to provide engine start control means which can prevent supply of starting fuel in an engine start under an engine temperature above a predetermined value.

According to the present invention, the above and other objects can be accomplished by an internal combustion engine comprising intake passage means, main carburetor means having throttle valve means disposed in said intake passage means, starter carburetor means including starting mixture supply passage means connected with said intake passage means downstream of said throttle valve means, starting fuel supplying means for supplying fuel to said starting mixture supply passage means, starter valve means provided in said starting mixture supply passage means and movable between open and closed positions, said starter valve means being of normally open type, valve actuating means responsive to an engine operating pressure for moving said valve means to said closed position when the engine operating pressure is introduced, pressure supply passage means for transmitting the engine operating pressure to said valve actuating means, check valve means disposed in said pressure supply passage means for allowing transmittal of the engine operating pressure only toward the valve actuating means, first temperature responsive valve means provided in said pressure supply passage means between the check valve means and the valve actuating means and adapted to be closed when engine temperature is below a first predetermined value but opened when the engine temperature is above the first predetermined value, bypass passage means for bypassing the check valve means, second temperature responsive valve means disposed in said bypass passage means and adapted to close said bypass passage means when the engine temperature is above a second predetermined value which is higher than the first predetermined temperature whereby the starter valve means is maintained at the closed position even after the engine is stopped under a temperature above the second predetermined temperature under the influence of the engine operating pressure retained in the valve actuating means.

According to the features of the present invention, as far as the engine temperature is high, that is, above the second predetermined temperature, the engine operating pressure is entrapped in the valve actuating means to maintain the starter valve means in the closed position even after the engine is stopped. Therefore, when the engine is started under a high engine temperature, it is possible to prevent supply of starting mixture to thereby eliminate the aforementioned problems in the conventional arrangement. The engine operating pressure may be an intake suction pressure drawn from the intake passage downstream of the throttle valve.

In accordance with a preferable aspect of the present invention, the first and second temperature responsive valve means are provided in a single housing having a single chamber. The chamber has a wall formed with a pair of openings, one of which is led to the valve actuating means and the other to the check valve means. A temperature responsive valve element is disposed for cooperation with the openings to constitute the first valve means. In another wall of the housing, there is formed an opening leading to the bypass passage and a temperature responsive valve element is disposed for cooperation with the opening to constitute the second valve means.

The above and other objects and features of the present invention will become apparent from the following descriptions of preferred embodiments taking reference to the accompanying drawings, in which:

FIG. 2(*b*) is a sectional view taken substantially along the line B—B in FIG. 2(*a*);

Figure 1:
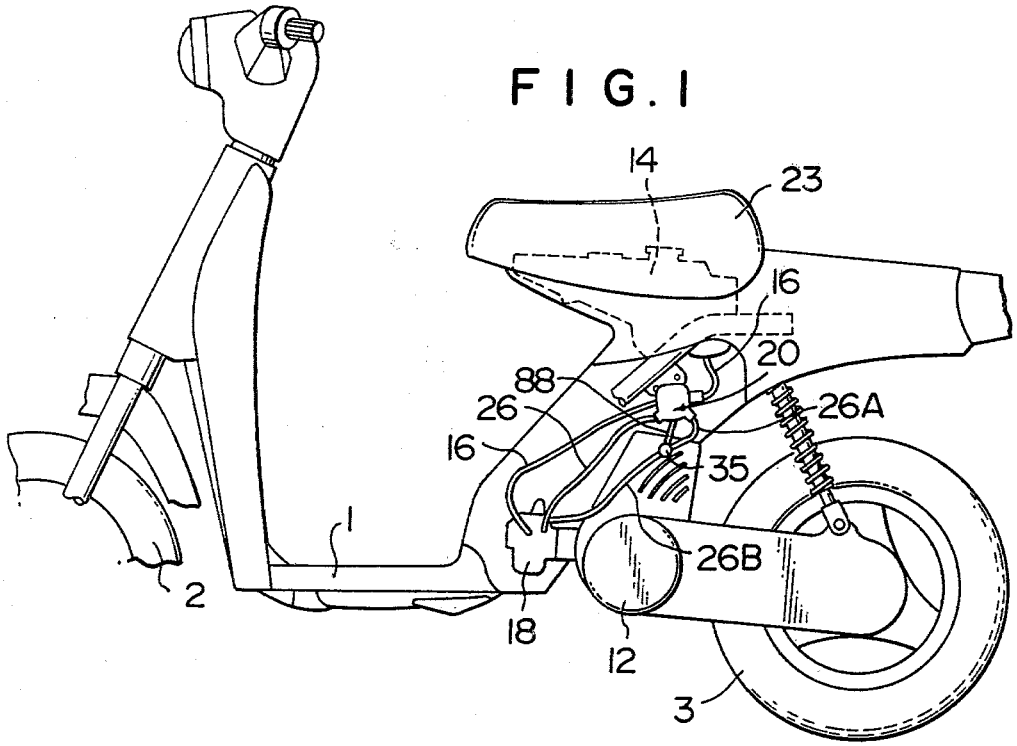
FIG. 1 is a fragmentary side view of a motor-cycle embodying the engine start control device in accordance with one embodiment of the present invention.

Referring now to the drawings, at first to FIG. 1, the motorcycle shown therein has a body 1 supported by a front and rear wheels 2 and 3, respectively. On the body 1, there is mounted an engine 12 which is adapted to drive the rear wheel 3. A fuel tank 14 which is also mounted on the body 1 provides a supply of fuel to the engine through a fuel supply line 16 and a carburetor 18. In the fuel supply line 16, there is provided a pressure responsive fuel valve 20. A driver's seat 23 is positioned above the fuel tank 14.

Figure 2:
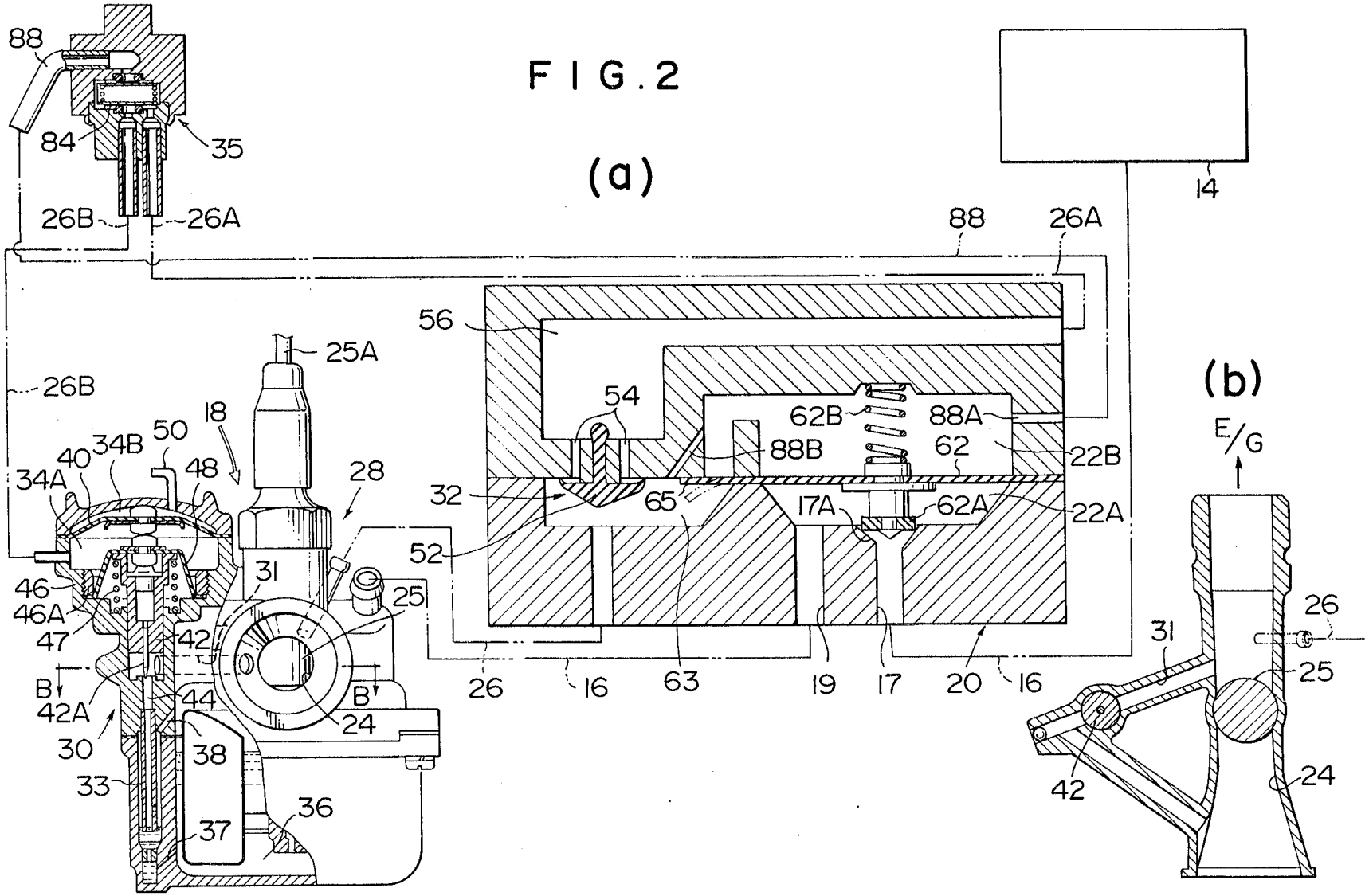
FIG. 2(*a*) is a diagrammatical sectional view of an engine starting mixture supply system employed in the device shown in FIG. 1.

Referring now to FIGS. 2(*a*) and (*b*), the carburetor 18 comprises a main carburetor 28 and a starter carburetor 30. The main carburetor 28 has an intake passage 24 leading to the engine 12 and is provided with a piston type throttle valve 25 which is adapted to be controlled by means of a throttle actuating cable 25A. A float chamber 36 is provided beneath the intake passage 24 and a main fuel nozzle (not shown) is opened to the intake passage 24 so that fuel is supplied from the float chamber 36 to the intake passage 24 in a manner well known in the art.

The starter carburetor 30 is comprised of a starting mixture supply passage 31 which opens at one end to the intake passage 24 upstream of the throttle valve 25 and at the other end to the intake passage 24 downstream of the throttle valve 25. The passage 31 has a cross-sectional area which is small in relation to that of the intake passage 24. In the starting mixture supply passage 31, there is provided a plunger type starter valve 42 for closing the passage 31. A starting fuel supply nozzle 44 is opened to the passage 31 at a position beneath the starter valve 42 and connected with a bleed pipe 33 which has a lower end communicating through a passage 37 with the float chamber 36. Around the bleed pipe 33, there is formed an annular space which is connected through a passage 38 with the upper portion of the float chamber 36 so that bleed air is supplied from the float chamber 36 to the bleed pipe 33. The starter valve 42 is provided with a needle 42A which is adapted to close the nozzle 44 when the valve 42 is moved to the closed position.

The starter valve 42 has an upper end secured to a diaphragm 48 of which periphery is secured to the carburetor housing 46 by means of a ring nut 46A. A spring 47 is disposed between the valve 42 and the housing 46 so that the valve 42 is forced upwardly to the open position. Above the starter valve 42, the carburetor housing 46 has a chamber which is divided by a diaphragm 40 into a lower suction chamber 34A and an upper atmospheric chamber 34B. The chamber 34B is opened to the atmosphere through a vent line 50. Thus, it will be understood that, by introducing a suction pressure into the chamber 34A, the starter valve 42 is forced against the action of the spring 47 into the closed position.

The suction pressure for actuating the starter valve 42 is drawn by a suction pressure line 26 which opens at one end to the intake passage 24 downstream of the throttle valve 25 and at the other end connected with the fuel valve 20. As shown in FIG. 2(*a*), the fuel valve 20 includes a diaphragm 62 which defines a fuel chamber 22A and a suction pressure chamber 22B. The fuel chamber 22A is provided with an inlet port 17 connected through the line 16 with the fuel tank 14 and an outlet port 19 connected with the float chamber 36 of the carburetor 28. The diaphragm 62 has a valve member 62A which cooperates with a valve seat 17A formed on the inlet port 17. A spring 62B disposed in the chamber 22B functions to force the diaphragm 62 so that the valve member 62A is biased into engagement with the valve seat 17A.

The fuel valve 20 further has an inlet chamber 63 which is on one hand connected through the line 26 with the intake passage 24 and on the other hand through a check valve 65 with the chamber 22B. Further, the chambers 22B and 63 are connected together by a bypass passage 88B of relatively small cross-sectional area. The inlet chamber 63 is connected with a chamber 56 through a check valve mechanism 32 which is comprised of a valve member 52 and passages 54. The check valve 32 allows a flow from the chamber 56 to the chamber 63 but blocks a flow in the opposite direction.

Figure 3:
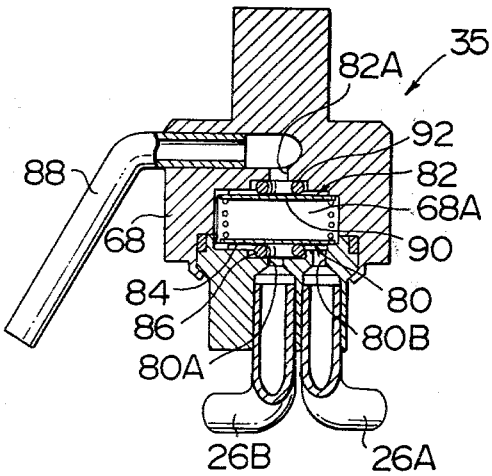
FIG. 3 is an enlarged sectional view of the temperature responsive valve device shown in FIG. 2(*a*)

The chamber 56 is connected with a passage 26A which leads to a temperature responsive valve assembly 35. As shown in FIG. 3, the valve assembly 35 includes a housing 68 having a chamber 68A in which a first valve 80 and a second valve 82 are assembled. The first valve 80 is comprised of a bimetal disc 84 and an O-ring 86 which encircles a port 80A formed in the housing 68. The aforementioned line 26A is connected to a port 80B which is located to open to the chamber 68A outside the O-ring 86, and the port 80A is connected through a line 26B with the chamber 34A. The bimetal disc 84 is so formed that, when the engine temperature is below a first predetermined value, for example, 40° C., it is maintained in contact with the O-ring 86 to break the communication between the lines 26A and 26B but, when the engine temperature is above the aforementioned value, it is bowed or deflected to move apart from the O-ring 86 so as to establish a communication between the lines 26A and 26B.

The second valve 82 is comprised of a bimetal disc 90 and an O-ring 92 which encircles a port 82A. The port 82A is connected through a line 88 and a port 88A in the fuel valve 20 with the suction pressure chamber 22B. The bimetal disc 90 is so formed that it is maintained in contact with the O-ring 92 to disconnect the port 82A from the chamber 68A when the engine temperature is above a second predetermined value, for example 60° C., which is higher than the first predetermined value. Under the engine temperature below the second predetermined value, the bimetal disc 90 is bowed to move apart from the O-ring 92 so that the line 88 is opened to the chamber 68A.

In operation, under the engine temperature below the first predetermined value, the starter valve 42 is held in the open position under the influence of the spring 47. Therefore, a supply of starting mixture is started through the passage 31 as soon as the engine is cranked. Since the cross-sectional area of the passage 31 is very small, the flow of the starting-mixture can be maintained at a high velocity and atomization of fuel can be enhanced.

After the engine has been started and the engine temperature has been increased to the first predetermined value, the first temperature responsive valve 80 is opened to connect the passages 26A and 26B. Thus, the engine intake pressure is transmitted through the line 26, the check valve 32 and the lines 26A and 26B to the chamber 34A whereby the starter valve 42 is forced downwards to the closed position. The bypass passage 88B is provided for relieving the suction pressure in the chamber 34A after the engine has been stopped. More specifically, when the engine is stopped, the atmospheric pressure is transmitted from the intake passage 24 through the line 26, the bypass passage 88B, the line 88, the valves 82 and 80, and the line 26B to the chamber 34A so as to return the starter valve 42 to the open position. It is therefore possible to supply the starting fuel without delay when the engine is cranked for next start.

When the engine temperature is sufficiently high so that the supply of starting mixture is not desirable for next engine start, the second temperature responsive valve 82 is closed to prevent leakage of the suction pressure in the chamber 34A through the bypass passage 88B. Thus, the suction pressure is maintained in the chamber 34A even after the engine is stopped to hold the starter valve 42 in the closed position. In this manner, it is possible to prevent the overall mixture from becoming excessively rich during the engine start under a high engine temperature.

Figure 5:
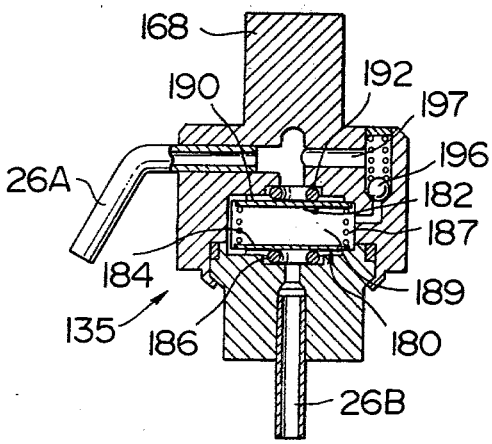
FIG. 5 is an enlarged sectional view of the temperature responsive valve device shown in FIG. 4.
Figure 4:
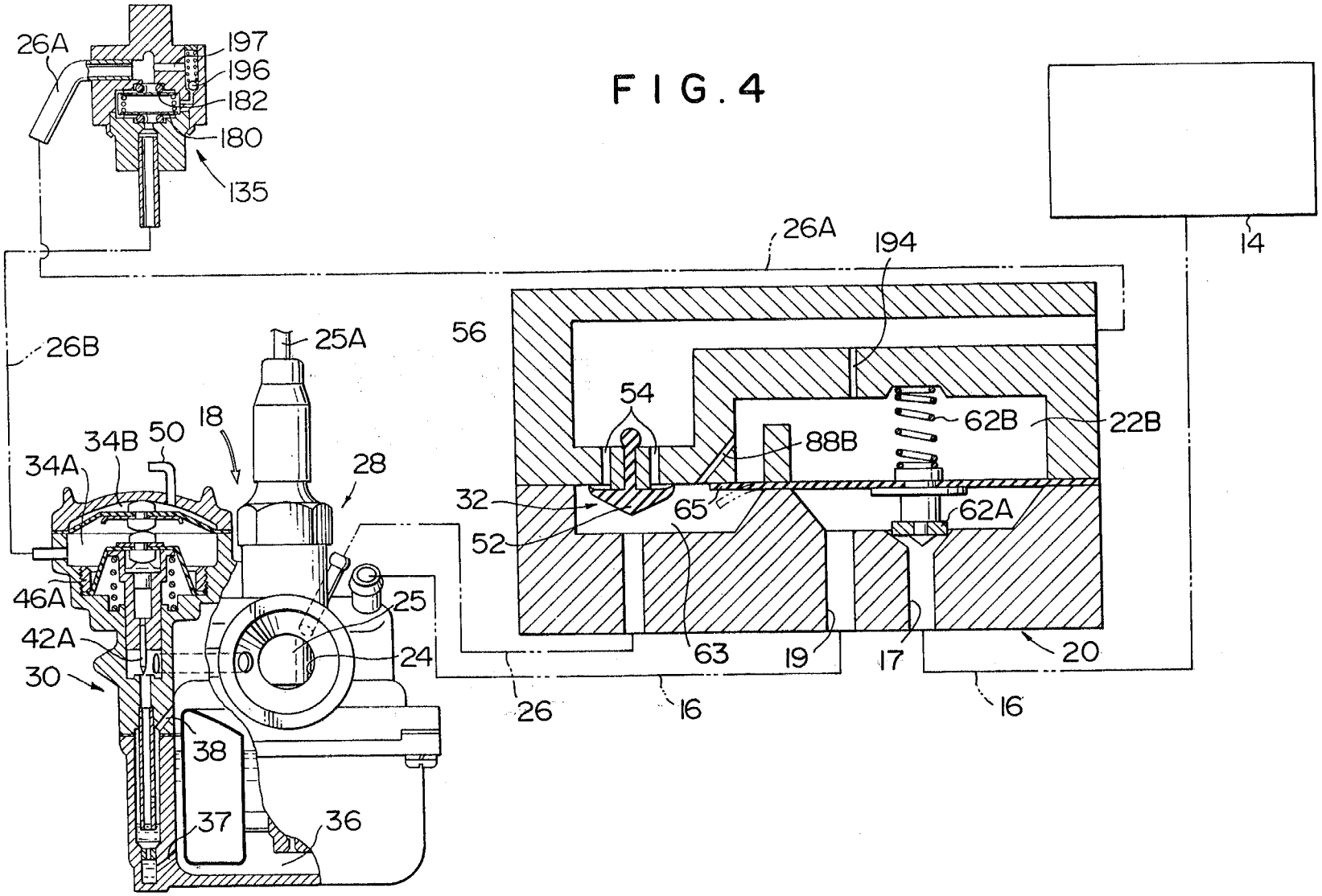
FIG. 4 is a view similar to FIG. 2(*a*) but showing another embodiment of the present invention.

Referring to FIGS. 4 and 5, the embodiment shown therein is substantially identical to the previous embodiment except the temperature responsive valve assembly so that corresponding parts are designated by the same reference numerals as in FIGS. 1 through 3. In this embodiment, the valve assembly which is designated by the reference numeral 135 includes a housing 168 having a chamber 187. The line 26A from the chamber 56 in the fuel valve 20 is connected through a check valve 196 and a passage 197 with the chamber 189. Further, the line 26A is connected with the chamber 189 through a second temperature responsive valve 182. As in the previous embodiment, the valve 182 is comprised of a bimetal disc 190 and an O-ring 192, and is so constructed that it is normally opened but closed when the engine temperature is above a second predetermined value.

The line 26B from the suction pressure chamber 34A is connected with the valve chamber 189 through a first temperature responsive valve 180 which is comprised of a bimetal disc 184 and an O-ring 186. The first valve 180 is normally closed but opened when the engine temperature is above a first predetermined value which is lower than the second predetermined value. In this embodiment, the suction pressure chamber 22B in the fuel valve 20 is connected with the chamber 56 through a bypass passage 194. A spring 187 is provided to act between the bimetal discs 184 and 190.

It should therefore be noted that the engine intake suction pressure is introduced into the chamber 34A as soon as the engine temperature reaches the first predetermined value through the line 26, the check valve 32, the chamber 56, the line 26A, the check valve 196, the first valve 180, and the line 26B. The suction pressure in the chamber 34A is relieved after engine stop through the second valve 182 as far as the engine temperature is below the second predetermined value. However, when the engine temperature is high, the valve 182 is closed to maintain the suction pressure in the chamber 34A to thereby hold the starter valve 42 in the closed position.

The invention has thus been shown and described with reference to specific embodiments, however, it should be noted that the invention is in no way limited to the details of the illustrated arrangements but changes and modifications may be made without departing from the scope of the appended claims.

We claim:

1. Internal combustion engine comprising intake passage means, main carburetor means having throttle valve means disposed in said intake passage means, starter carburetor means including starting mixture supply passage means connected with said intake passage means downstream of said throttle valve means, starting fuel supply means for supplying fuel to said starting mixture supply passage means, starter valve means provided in said starting mixture supply passage means and movable between open and closed positions, said starter valve means being of normally open type, valve actuating means responsive to an engine operating pressure for moving said valve means to said closed position when the engine operating pressure is introduced, pressure supply passage means for transmitting the engine operating pressure to said valve actuating means, check valve means disposed in said pressure supply passage means for allowing transmittal of the engine operating pressure only toward the valve actuating means, first temperature responsive valve means provided in said pressure supply passage means between the check valve means and the valve actuating means and adapted to be closed when engine temperature is below a first predetermined value but opened when the engine temperature is above the first predetermined value, bypass passage means for bypassing the check valve means, second temperature responsive valve means disposed in said bypass passage means and adapted to close said bypass passage means when the engine temperature is above a second predetermined value which is higher than the first predetermined temperature whereby the starter valve means is maintained at the closed position even after the engine is stopped under a temperature above the second predetermined temperature under the influence of the engine operating pressure retained in the valve actuating means.

2. Engine in accordance with claim 1 in which said first and second temperature responsive valve means are provided in a single housing.

3. Engine in accordance with claim 2 in which said housing includes a single chamber having a wall formed with a pair of openings, one of which is led to the valve actuating means and the other to the check valve means, a temperature responsive valve element in the chamber for cooperation with the openings to constitute the first valve means, said chamber having another wall formed with an opening leading to the bypass passage, a second temperature responsive valve element for cooperation with the opening to constitute the second valve means.

4. Engine in accordance with claim 2 in which said housing includes a single chamber which is on one hand connected with the check valve means and the bypass passage means through the second temperature responsive valve means and second check valve means which blocks a flow toward the chamber, and on the other hand through the first temperature responsive valve means with the valve actuating means.

5. Engine in accordance with claim 4 in which at least one of said first and second temperature responsive valve means is comprised of a temperature responsive valve element cooperative with a port opening to the chamber in the housing.

* * * * *